United States Patent [19]

McLennan

[11] 4,015,768

[45] Apr. 5, 1977

[54] SEALED END CARTON WITH RECLOSABLE POURING OPENING

[75] Inventor: Noel McLennan, Mount Waverly, Australia

[73] Assignee: Nicholas Proprietary Ltd., Australia

[22] Filed: July 23, 1975

[21] Appl. No.: 605,374

[30] Foreign Application Priority Data

July 23, 1974 Australia ..... 8293/74
Nov. 27, 1974 Australia ..... 9789/74

[52] U.S. Cl. ..... 229/17 R
[51] Int. Cl.[2] ..... B65D 5/72
[58] Field of Search ..... 229/17, 37, 7

[56] References Cited

UNITED STATES PATENTS

| | | | |
|---|---|---|---|
| 2,925,948 | 2/1960 | Alden | 229/17 R |
| 3,199,761 | 8/1965 | Hill | 229/17 R |
| 3,438,565 | 4/1969 | Lugt et al. | 229/17 R |
| 3,549,079 | 12/1970 | Northrup | 229/17 R |
| 3,563,447 | 2/1971 | Katzenmeyer | 229/17 R |
| 3,580,466 | 5/1971 | Thelen | 229/17 R X |

*Primary Examiner*—Davis T. Moorhead
*Attorney, Agent, or Firm*—William Anthony Drucker

[57] ABSTRACT

A container for the storage and dispensing of pourable materials is formed of sheet packaging material and has means defining a reclosable pouring opening, said means comprising:

an inner sheet having a tongue defined by a cut line in the inner sheet, the tongue being hingedly liftable to form a pouring opening and hingedly returnable for engagement with the inner sheet to close the pouring opening;

an outer sheet overlying and sealingly adhered to the inner sheet and having a tab defined by one or more lines of weakness in the outer sheet, the tab overlying the tongue and part of the inner sheet with its base overlying the base of the tongue, the tab being adhered to the tongue but substantially unadhered to the inner sheet so as to be hingedly liftable from the inner sheet;

the container being openable by hingedly lifting the tab whereby the line or lines of weakness is or are severed and the tongue is hingedly lifted to form the pouring opening, and reclosable by pressing the tab against the inner sheet whereby the tab frictionally engages the outer sheet and the tongue is pressed into re-engagement with the inner sheet.

A blank of sheet packaging material for assembly into such a container is also provided.

7 Claims, 4 Drawing Figures

SEALED END CARTON WITH RECLOSABLE POURING OPENING

This invention relates to a container for the storage and dispensing of pourable materials and to a blank of sheet packaging material suitable for assembly into such a container.

In this specification the following terms are defined to have the following meanings:

a carton means a container made from paperboard, fibreboard or like material which will usually be of thickness of from 0.305 mm to 1.118 mm;

a glue-end carton means a carton having an end closure of the kind shown in BS 1133 (1967): Section 7 at page 73;

a panel means a part of a container or blank connected at each of its edges to other parts of the container or blank; and a flap means a part of a container or blank attached at one edge to the remainder of the container or blank, the edge usually being defined by a crease or score line.

Containers for pourable materials are often supplied to the manufacturer in the form of appropriately shaped blanks of sheet packaging material which are assembled at a packaging point, filled with the desired pourable material and then sealed. It may be desirable to provide a reclosable pouring opening in such containers in cases where the contents are not likely to be used all at once. A variety of designs for containers having a reclosable pouring openings have been suggested, but it has proved difficult to arrive at a design which is satisfactory in use and practical from the manufacturing standpoint. The drawbacks associated with previous designs are, for example, complicated shape which increases manufacturing cost, increase in bulk of the container in the area of the pouring opening, weakening of the container in the area of the pouring opening, and incomplete reclosure with consequent risk of spillage of the contents of the container.

We have found that a simple but effective reclosable pouring opening for a container can be formed by providing on an inner sheet a tongue which is engageable with the inner sheet to form a closure for the container and hingedly liftable to form a pouring opening, and overlaying and sealingly adhering to the inner sheet an outer sheet containing a tab defined by one or more lines of weakness in the outer sheet. The container is formed so that the tab overlies the tongue and part of the inner sheet with its base overlying the base of the tongue, and the tab is adhered to the tongue and is hingedly liftable from the inner sheet. Such a container is particularly suitable for the packaging of powdered or granulated solid materials.

The present invention therefore provides a container for the storage and dispensing of pourable materials, the container being formed of sheet packaging material and having means defining a reclosable pouring opening, said means comprising:

an inner sheet having a tongue defined by a cut line in the inner sheet, the tongue being hingedly liftable to form a pouring opening and hingedly returnable for engagement with the inner sheet to close the pouring opening; and an outer sheet overlying and sealingly adhered to the inner sheet and having a tab defined by one or more lines of weakness in the outer sheet, the tab overlying the tongue and part of the inner sheet with its base overlying the base of the tongue, the tab being adhered to the tongue but substantially unadhered to the inner sheet so as to be hingedly liftable from the inner sheet;

the container being openable by hingedly lifting the tab whereby the line or lines of weakness is or are severed and the tongue is hingedly lifted to form the pouring opening, and reclosable by pressing the tab against the inner sheet whereby the tab frictionally engages the outer sheet and the tongue is pressed into re-engagement with the inner sheet.

Preferably the opening is provided in the top end of the container which is in the form of a box-shaped glue-end carton, in which case the inner sheet and the outer sheet are constituted by a first pair of opposite end flaps in which the tongue and the tab are disposed on opposite middle portions of said flaps, a second pair of opposite end flaps being dimensioned such that the tongue is disposed between their inner edges and is directly in contact with the interior of the carton. Alternatively the opening can be provided in the side of the carton, in which case the tongue and tab can be formed in side flaps which are folded to form the side closure of the carton.

The lines of weakness in the outer sheet which define the tab are preferably a series of cuts constituting a zig-zag pattern. The tab preferably has a hinge crease or score line at its base and is dimensioned such that its outer edge projects slightly from the front of the container to facilitate grasping of the tab by a user. As previously explained, the tab is adhered to the tongue, but for it to be hingedly liftable from the inner sheet, it should not be adhered, or it should be only weakly adhered, to the inner sheet. Accordingly, it may be desirable to coat an appropriate area of the inner sheet adjoining the tongue and overlaid by the tab when the tab is in the closed position with a layer of glue - repellent material such as ink or varnish. Alternatively an area of the tab not overlaid by the tongue may be coated with a layer of the glue - repellent material. However, the coating of glue - repellent material will not be applied to the tongue or to the under surface of the outer sheet because it is desirable that the outer and inner sheets should be strongly adhered together except where the tab overlies the inner sheet. Furthermore, during sealing of the carton of the invention it is desirable to avoid applying adhesive to the inner surface of the inner sheet in the area bounded by the cut defining the tongue because hardened adhesive makes the tongue more difficult to lift to form the pouring opening and more difficult to return for re-engagement with the inner sheet.

In a further aspect, the invention provides a blank of sheet packaging material for forming into a box-shaped glue end container of the kind previously referred to, comprising:

a section divided by lateral and vertical score lines into a front panel, a first side panel, a rear panel and means foldable into a closure for the second side of the container, said means comprising a second side flap foldable into overlap with the first side flap or a second side panel and a glue flap foldable into overlap with the front panel;

end flaps at each end of the front and rear panels and at each end of the first side panel and either at each end of the first and second side flaps or at each end of the second side panel, the end flaps being foldable to form a glue-end closure for the container;

a first end or side flap having a tongue defined by a cut line in said flap, the tongue being hingedly liftable to form an opening and re-engageable with said first end or side flap to close said opening; and a second end or side flap having a hingedly liftable tab of greater length and width than the tongue and defined by one or more lines of weakness formed such that the tab after serverance of said lines of weakness is frictionally re-engageable with the second end or side flap, the second end or side flap being foldable to overlie the first end or side flap with the tab overlying the tongue and part of the first end or side flap, the base of the tab overlying the base of the tongue.

A preferred construction of carton according to the invention is illustrated in the following drawings, in which.

Figure 1:
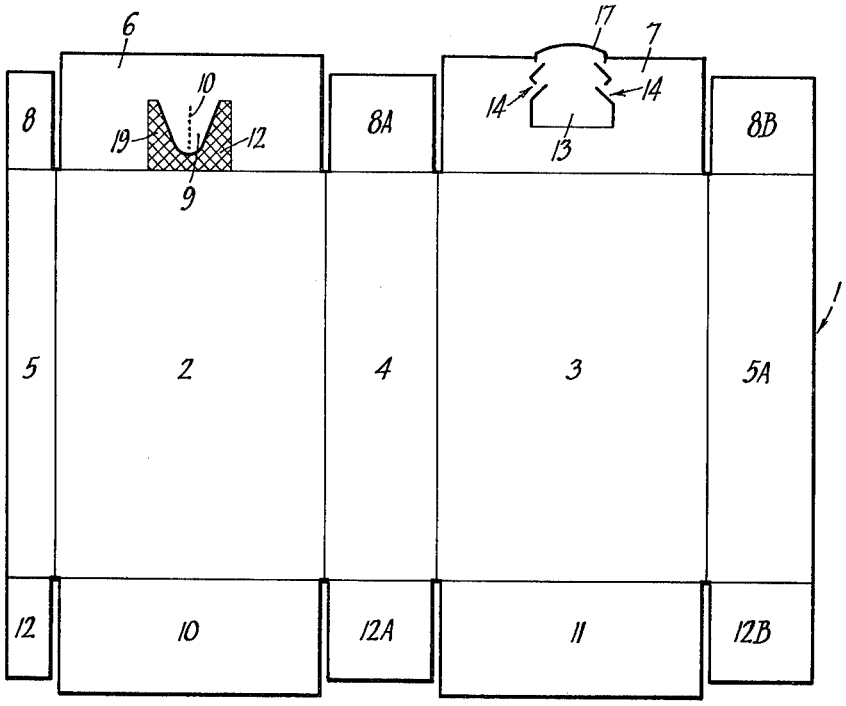
FIG. 1 is a plan view of a paperboard blank suitable for assembly into a carton according to the invention.

Referring to the drawings, FIG. 1 shows a substantially rectangular cardboard carton blank 1 divided by lateral and vertical score lines into a first side flap 5, a front panel 2, a side panel 4, a rear panel 3 and a second side flap 5A. Top end flaps 6 and 7 and bottom end flaps 10 and 11 are provided at the ends of the front and rear panels. Closure flaps 8, 8A, 8B and 12, 12A, 12B are provided at the respective top and bottom ends of the first side flap 5, the side panel 4 and the second side flap 5A. The top end flap 6 embodies a tongue 9 formed in the middle of the flap by a V - or U - shaped cut, the tongue being provided with a row of spaced - apart creases 10 to promote adhesive absorption. An area 19 in the middle of the end flap 6 surrounding the tongue 9 is coated with a layer of ink or varnish to reduce adhesive absorption. The top end flap 7 embodies a hingedly liftable tab 13 of greater length and width than the tongue 9, formed in the middle of the flap, and defined by lines 14 of weakness which are formed by a series of unconnected cuts constituting a zig-zag pattern, and by a hinge score line at the base of the tab 13. The tab 13 has an outer projecting portion 17 which in the assembled and sealed carton projects slightly beyond the top edge of the carton.

Figure 2:
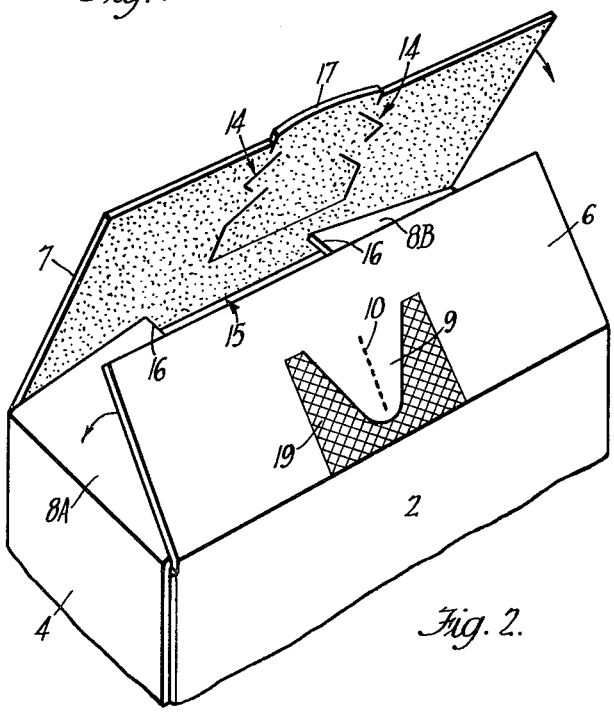
FIG. 2 is a perspective view of the top end portion of a carton assembled from a blank as shown in FIG. 1 showing the way in which the end flaps are folded to form a closure for the carton.
Figure 3:
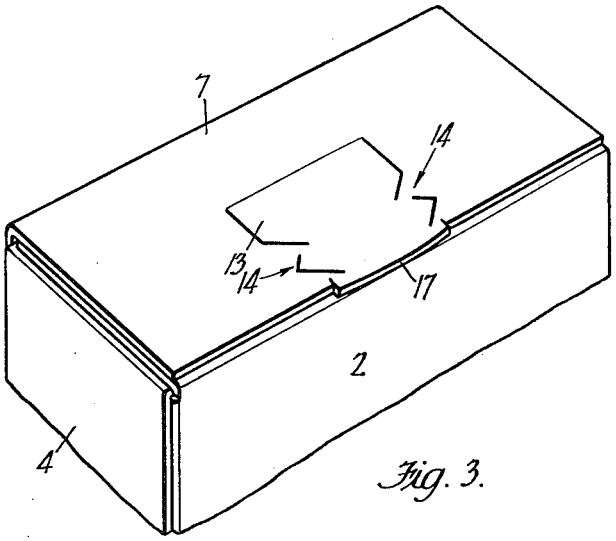
FIG. 3 is a perspective view of the top end portion of the carton shown in FIG. 2 after it has been sealed.

The blank shown in FIG. 1 may be assembled into a carton in the usual way by folding and adhering by means of adhesive and pressure the first and second side flaps 5 and 5A, the bottom end flaps 10 and 11 and the bottom closure flaps 12, 12A and 12B so as to form a box-shaped carton having a glue-end closure at its bottom end. The assembled carton is then filled through the top end with the desired contents which will usually be a powdered or granulated solid material. Sealing of the top end of the carton is effected as shown in FIG. 2 to form a glue-end closure at the top of the carton, the closure flaps 8, 8A and 8B being folded beneath the end flap 6 which in the closed carton is the inner end flap, after which the flap 7 which becomes the outer end flap is folded so as to overlie the end flap 6 and is sealingly adhered thereto. During the folding operation the tongue 9 lies opposite and below the tab 13. The assembled sealed carton is shown in FIG. 3, and it will be appreciated that the tab 13 overlies the tongue 9 and the area 19 in the middle of the inner end flap 6, and the hinge score at the base of the tab 13 approximately overlies the base of the tongue 9. The closure flaps 8, 8A and 8B are adhered to the inner end flap 6 by means of adhesive and pressure and the outer end flap 7 is similarly adhered to the inner end flap 6.

The tab 13 is adhered to the tongue 9 but is not adhered, or is only weakly adhered to the area 19 in the middle of the inner end flap. The tongue 9 in the assembled and sealed carton is disposed in a gap 15 between inner edges 16 of the closure flaps 8, 8A and 8B and therefore is in direct contact with the interior of the carton.

Figure 4:
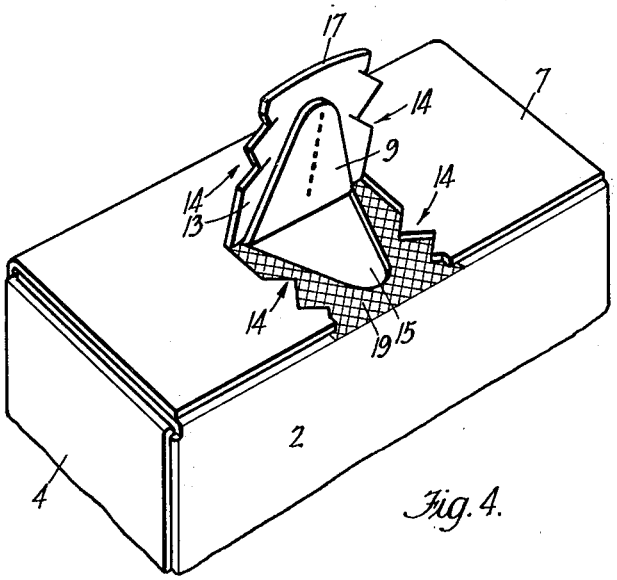
FIG. 4 is a perspective view of the top end portion of the carton shown in FIG. 3 after the carton has been opened by hingedly lifting the tab in the outer end flap.

The assembled and sealed carton can be opened by grasping the outer projecting edge portion 17 of the tab 13 and lifting the tab 13 so as to tear the lines 14 of weakness and separate the tab 13 from the outer end flap 7 except for the hinged score line at the base of the tab 13. The tongue 9 which is attached to the tab 13 is thereby hingedly lifted away from the inner end flap 6 to form a pouring opening 15 as shown in FIG. 4. The coating of ink or varnish on the area 19 of the inner end flap 6 reduces penetration of adhesive into that area of the flap and facilitates lifting of the tongue. Reclosure of the carton can be effected by pressing the tab 13 towards the inner end flap 6 whereby the tongue 9 is pressed into relatively tight fitting re-engagement with the inner end flap 6 and the tab 13 frictionally engages the outer end flap 7. As an alternative to coating the ink or varnish in the area 19 of the inner end flap around the tongue member 9, a similar coating can be applied to those areas of the tab 13 which in the assembled and sealed carton do not overlap with the tongue member 9. In this alternative construction, the tongue 9 still adheres to the tab 13 but any adhesion of the tab 13 to the inner end flap 6 is reduced so that the tab can readily be lifted away from the inner end flap when the carton is opened.

I claim:

1. A container for the storage and dispensing of pourable materials, the container being formed of sheet packaging material and having means defining a reclosable pouring opening, said means comprising:

an inner sheet having a tongue defined by a cut line in the inner sheet, the base of said tongue being free of scoring and being liftable by bending against its inherent resiliency to form a pouring opening and returnable for frictional engagement with said inner sheet to close said pouring opening by pressure applied thereto;

an outer sheet overlying and sealingly adhered to said inner sheet, said outer sheet having lines of weakness defining and being severable to provide a tab frictionally re-engageable with said outer sheet, said tab overlying said tongue and part of said inner sheet with its base overlying the base of said tongue, said tab being adhered to said tongue but substantially unadhered to said inner sheet so as to be hingedly liftable from said inner sheet;

said container being openable by hingedly lifting said tab whereby said lines of weakness are severed and said tongue is hingedly lifted to form said pouring opening, and reclosable by pressing said tab against said inner sheet whereby said tab frictionally engages said outer sheet and said tongue is pressed into frictional re-engagement with said inner sheet, said lines of weakness defining said tab comprise a series of unconnected cuts constituting a zig-zag pattern extending to the edge of the outer sheet, a hinge crease or score line being provided at the base of said tab, said container is a box-shaped carton.

2. A container according to claim 1, wherein an area of said inner sheet adjoining said tongue and overlaid by said tab when said tab is in the closed position is coated with a layer of glue-repellant material.

3. A container according to claim 1, wherein an area of the inner surface of said tab not overlying said tongue is coated with a layer of glue-repellant material.

4. A container according to claim 1, wherein said inner sheet and said outer sheet are constituted by a first pair of opposite end flaps in which said tongue and said tab are disposed on opposite middle portions of said flaps, a second pair of opposite end flaps being dimensioned such that said tongue is disposed between inner edges of said flaps and is directly in contact with the interior of said carton.

5. A blank of sheet packaging material for assembly into a container according to claim 1, said blank comprising:

a section divided by lateral and vertical score lines into a front panel, a first side panel, a rear panel and means foldable into a closure for a second side of said container, said means comprising a second side flap foldable into overlap with said first side flap or a second side panel and a glue flap foldable into overlap with said front panel;

end flaps at each end of said front and rear panels and at each end of said first side panel and either at each end of said first and second side flaps or at each end of said second side panel, said end flaps being foldable to form a glue-end closure for said container;

a first end or side flap having a tongue defined by a cut line in said flap, the base of said tongue being unscored and liftable by bending against its inherent resiliency to form an opening and frictionally re-engageable with said first end or side flap to close said opening by applied pressure; and a second end or side flap having a hingedly liftable tab of greater length and width than said tongue and defined by one or more lines of weakness formed such that said tab after severance of said lines of weakness is frictionally engageable with said second end or side flap, said second end or side flap being foldable to overlie said first end or side flap with said tab overlying said tongue and part of said first end or side flap, the base of said tab overlying the base of said tongue, said lines of weakness defining said tab comprising a series of unconnected cuts constituting a zig-zag pattern extending to the edge of the second end or side flap and having a hinge crease or score line provided at the base of said tab, said first and second end or side flaps being constituted by a first pair of opposite end flaps having said tongue and said tab disposed on opposite middle portions of said flaps, a second pair of opposite end or side flaps being dimensioned such that in the assembled and sealed carton the tongue is disposed between their inner edges and is directly in contact with the interior of said carton.

6. A blank according to claim 5, wherein an area of said first end or side flap adjoining said tongue and foldable to lie under said tab is coated with a layer of glue-repellant material.

7. A blank according to claim 5, wherein an area of said tab not foldable to overlie said tongue is coated with a layer of glue-repellant material.

* * * * *